US006731067B1

(12) United States Patent
Woodward et al.

(10) Patent No.: US 6,731,067 B1
(45) Date of Patent: May 4, 2004

(54) ELIMINATION OF WELD IN CERAMIC METAL HALIDE ELECTRODE-LEADWIRE

(75) Inventors: James R. Woodward, Chagrin Falls, OH (US); James T. Dakin, Shaker Heights, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/393,563

(22) Filed: Sep. 10, 1999

(51) Int. Cl.[7] ..... H01J 61/06
(52) U.S. Cl. ..... 313/631; 313/638
(58) Field of Search ..... 313/631, 632, 313/633, 637, 623, 25, 493, 634, 638, 607; 445/35

(56) References Cited

U.S. PATENT DOCUMENTS 3,832,590 A * 8/1974 Yamazaki et al. ..... 313/218
4,275,329 A * 6/1981 Fridrich et al. ..... 313/628
4,527,097 A * 7/1985 van der Heijden et al. . 315/246
4,552,269 A * 11/1985 Chang ..... 383/211
4,959,588 A * 9/1990 Vida et al. ..... 313/625
5,751,111 A * 5/1998 Stoffels et al. ..... 313/606
5,866,982 A * 2/1999 Scott et al. ..... 313/634
5,932,969 A * 8/1999 Ikeuchi et al. ..... 313/623
5,994,839 A * 11/1999 Yamamoto et al. ..... 313/570
6,054,810 A * 4/2000 Yamamoto et al. ..... 313/607
6,208,070 B1 * 3/2001 Sugimoto et al. ..... 313/493

* cited by examiner

*Primary Examiner*—Nimeshkumar D. Patel
*Assistant Examiner*—Karabi Guharay
(74) *Attorney, Agent, or Firm*—Fay, Sharpe, Fagan, Minnich & McKee, LLP

(57) ABSTRACT

An apparatus for improving the performance of a ceramic metal halide (CMH) lamp includes an interior chamber (12) disposed within an outer envelope (10). In a preferred arrangement, two legs (14, 16) extend laterally in opposite directions from the chamber. Each leg encloses an electrode/leadwire assembly (22, 24). The electrode/leadwire assembly is constructed from a single continuous piece of wire, preferably tungsten, which forms a shaft or mandrel (50). One end of the mandrel supports an electrode tip (52) which is also preferably made from tungsten. The mandrel also supports an overwind component (54) at a predetermined position. In a desired arrangement, the overwind component is made from molybdenum. The single or one-piece mandrel negates the need for a welded shank assembly resulting in a stronger and more stable lamp that is less expensive to manufacture.

15 Claims, 2 Drawing Sheets

ELIMINATION OF WELD IN CERAMIC METAL HALIDE ELECTRODE-LEADWIRE

FIELD OF THE INVENTION

This invention pertains to an apparatus for improving the performance of Ceramic Metal Halide (CMH) lamps by replacing the current four-part electrode/leadwire assembly used in typical CMH lamps with a three-part electrode/leadwire assembly. More particularly, the invention relates to a uniquely configured electrode/leadwire assembly having a single continuous elongated shaft or mandrel which supports an electrode tip and a transition overwind component and eliminates a welded interconnection previously used in present assemblies to join together shank portions of dissimilar material that support molybdenum and tungsten portions of the lamp assembly together.

DISCUSSION OF THE ART

CMH lamps have become increasingly more popular due to their significant customer benefits. CMH lamps replace more traditional quartz arctubes found in arc discharge lamps with a ceramic arctube. CMH lamps provide better color uniformity and stability, as well as increased lumens per watt, relative to traditional arc discharge lamps. Because the ceramic arctube can operate at a higher temperature than a comparable quartz arctube and has a much lower rate of sodium loss, a CMH lamp is able to achieve the foregoing advantages.

In conventional CMH lamps, the electrode leads are manufactured and assembled from at least four distinct parts. The five part electrode/leadwire assembly, for example as used in 70 watt and 100 watt CMH lamps, includes an electrode tip (generally formed from tungsten), an overwind component (generally formed from molybdenum), an electrode mandrel, an overwind mandrel, and a niobium outer lead. The electrode mandrel and the overwind mandrel are welded together to form a shank. The two pieces of wire that comprise the shank are typically tungsten and molybdenum, with the latter having a larger diameter. Once the wires are welded together, the tungsten section of the mandrel supports the electrode tip and the molybdenum section supports the overwind component. Together, these components form the electrode/leadwire assembly. The niobium outer lead is also welded to the outer end of the molybdenum section of the shank.

Current CMH lamps are difficult to fabricate with precise alignment and stability between the tungsten electrode tip section and the molybdenum transition section. These difficulties are associated with the fact that the mandrel is presently constructed from two pieces of dissimilar materials, adding further complexity to the assembly. Because the two wires are so small, welding them together with precision is a difficult and arduous task resulting in low yields from the welding process, alignment problems, and decreased stability. As a consequence, CMH lamps encounter undesirable failures due to broken electrode tips caused when the weld breaks.

To date, the difficulties in manufacturing electrode/leadwire assemblies for ceramic metal halide lamps and the attendant problems associated therewith have not been resolved. The CMH lamps currently in existence lack the strength and stability to provide optimum performance. The prior art, which incorporates the four-part electrode/leadwire assembly, has not adequately remedied the shortcomings of present CMH lamps. Thus, a need exists to provide an electrode/leadwire assembly that is easier to manufacture and which provides increased strength and stability in operation.

SUMMARY OF THE INVENTION

A new and improved electrode/leadwire assembly for a ceramic metal halide lamp is provided having increased strength and stability.

In an exemplary embodiment of the invention, the apparatus employs an electrode/leadwire assembly having a single continuous mandrel, shank, or shaft supporting an electrode tip and an overwind component.

The CMH lamp preferably includes an envelope enclosing an interior chamber having elongated legs extending therefrom. Each leg houses an electrode/leadwire assembly. The shaft or mandrel of the electrode/leadwire assembly is constructed from a single, continuous, homogenous wire preferably formed from tungsten. The inner end of the mandrel supports an electrode tip also made from tungsten. In addition, a molybdenum overwind component is supported by the mandrel at a predetermined position spaced from the electrode tip. During manufacture of the electrode/leadwire assembly, the electrode tip and overwind component are attached to the mandrel through conventional winding and tacking techniques. Because the mandrel is formed from a single element, the present invention eliminates the welded arrangement. As a result, the electrode/leadwire assembly is stronger and more stable which prevents early lamp failure.

A principal advantage of the invention is provided by eliminating the weld in CMH electrode/leadwire assemblies, thereby reducing lamp shrinkage and increasing the leadwire's stability.

Another advantage of the invention resides in the improved concentricity of the electrode tip, which reduces arctube wall corrosion, resulting in increased lamp life and better performance.

Still another advantage of the invention is a more consistent heat conduction from the electrode tip, thereby increasing lamp life by reducing tip burn back and reducing operating voltage rise.

Yet another advantage of the invention resides in the reduced cost to manufacture this less complex ceramic metal halide lamp.

Still other advantages and benefits of the invention will become apparent to those skilled in the art upon a reading and understanding of the following detailed description.

DETAILED DESCRIPTION OF THE PREFERRED EMBODIMENT

Figure 1:
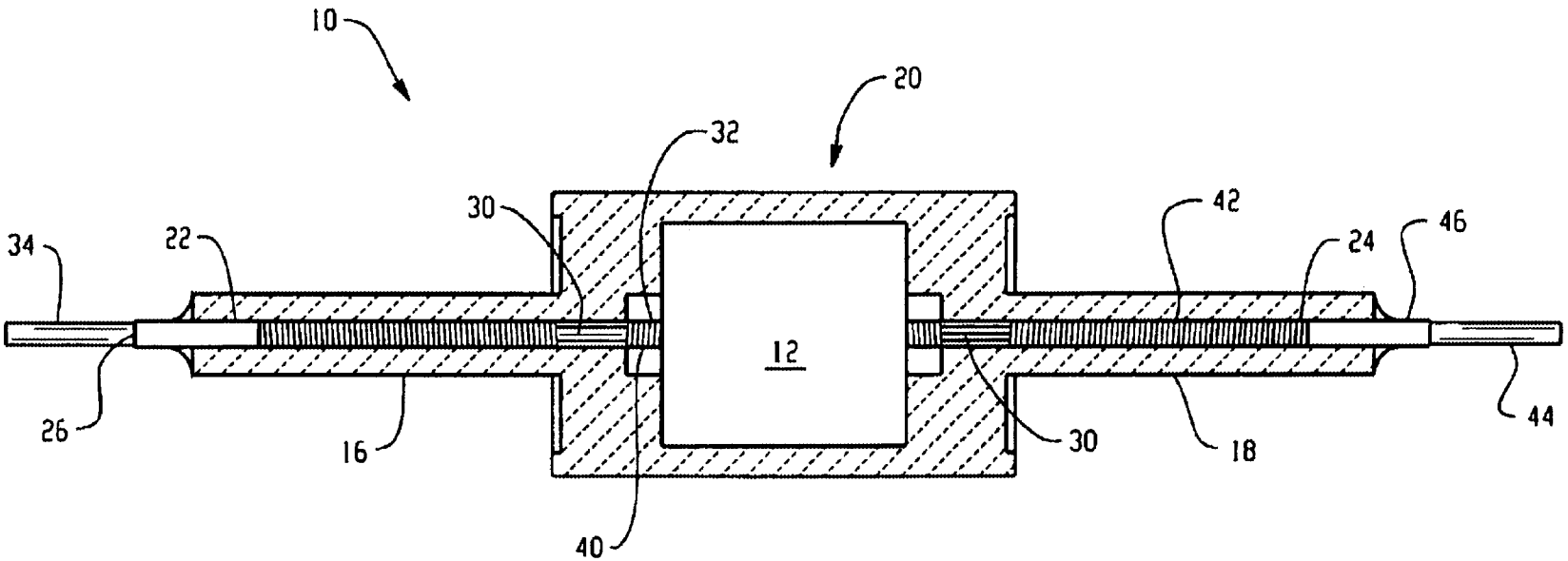
FIG. 1 is an elevational view of a lamp assembly according to a preferred embodiment of the present invention.

Referring now to the drawings, FIG. 1 shows a lamp assembly A having a hollow body or lamp envelop 10 defining an interior cavity or chamber 12. The lamp body 10 or ceramic arctube is a conventional, well known structure to those skilled in the art. In an exemplary embodiment, the interior chamber 12 communicates with first and second legs 16, 18 extending from opposite ends of the envelope. The legs receive first and second electrode/leadwire assemblies 22, 24 that are electrically connected to an external power source (not shown). Inner ends of the leadwire assemblies terminate within the chamber in spaced relation so that an arc discharge formed therebetween ionizes a fill gas contained in the sealed chamber and emits light in a manner well known in the art.

The leadwire assemblies 22, 24 are received through an opening 26 of the legs 16, 18, respectively, and extend through the entire length of the legs. The leg openings are sealed at the entry point of the electrode leadwires. The preferred method of sealing the interior chamber is accomplished through frit sealing; however, it will be appreciated that any sealing method known in the art could be used without departing from the scope and intent of the subject invention.

Figure 2:
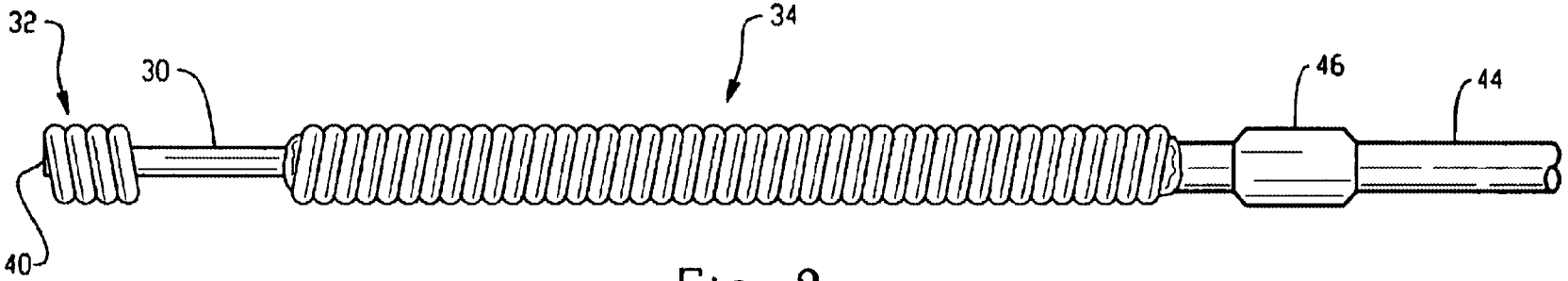
FIG. 2 is an elevational view of a typical electrode leadwire assembly.

Turning now to FIG. 2, a conventional electrode leadwire assembly is illustrated in greater detail for purposes of comparing with the improved electrode/leadwire assembly of the present invention described in greater detail below in conjunction with FIG. 3. It will be recognized that each leadwire assembly is substantially identical to the other unless specifically noted otherwise. The electrode/leadwire assembly of FIG. 2 has a shaft or mandrel 30 constructed from an assembly of dissimilar materials, i.e., tungsten and molybdenum, referenced as first and second ends 32, 34, respectively. The first or inner end 32 of the mandrel supports an electrode tip 40, which is preferably constructed from tungsten. It is appreciated however that any other appropriate material may be used in accordance with the present invention. The electrode tip 40 is operatively associated or secured to the first end 32 of the mandrel in a conventional manner known to those skilled in the art.

In addition to supporting the electrode tip 40, the mandrel supports an overwind component 42 which is located at a predetermined position on the mandrel spaced from the electrode tip. The overwind component 42 is preferably a molybdenum winding or overwind that is disposed within the leg opening. Although molybdenum is commonly used and preferred since it is less prone to cracking than other materials, it is recognized that the overwinding may be formed from any other appropriate material. The overwind component 42 is operatively associated or secured to the mandrel at a predetermined position, shown here on the second or niobium portion of the mandrel.

As described in the Background, the first and second ends of the mandrel are welded together. Due to the small size of these mandrel components, welding is generally considered to be a difficult process that does not realize the desired yields. Welding the dissimilar materials together encounters, for example, failures as a result of the tips breaking, misalignment of the electrode tip, shrinkage, decreased lamp life, less uniform heat conduction, etc.

The electrode/leadwire assembly, particularly the electrode tip, is located in the envelope via the niobium 44. In the preferred arrangement, a crimp 46 is formed in the niobium wire portion that is larger than the opening 26 in the legs.

Figure 3:
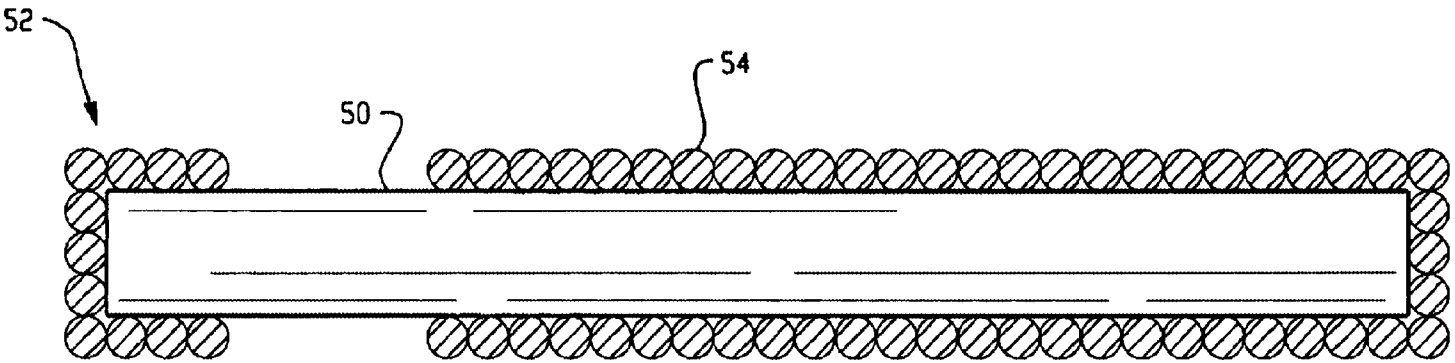
FIG. 3 is a cross-sectional view of the electrode/leadwire assembly formed in accordance with a preferred embodiment of the present invention.

Referring now to FIG. 3, a cross sectional view of the electrode/leadwire assembly is illustrated in accordance with the present invention. The use of a single piece of wire to form the shank or mandrel negates the need to weld two separate pieces of wire together and overcomes the issues noted above with regard to voids, porosity, misalignment, etc. associated with the conventional electrode leadwire assembly. Rather, a shaft 50 constructed from one piece of wire rather than two advantageously provides a stronger and more easily manufactured assembly. The elongated shaft or mandrel is preferably made from tungsten, however it will be understood that other materials may be used without departing from the scope and intent of the present invention. An important feature of the present invention is the use of a constant diameter shank preferably formed from a single, homogenous material that eliminates the problems associated with the two part welded arrangement of known CMH lamp assemblies. It is also contemplated that the overwind and electrode tip of the assembly can be formed from the same material. For example, tungsten can be used at the electrode tip 52 and also as the overwind component 54. Using tungsten as the overwind component rather than molybdenum would provide for ease of assembly as a result of merely starting and stopping the coiling operation along the length of the one-piece shank. For example, the ends of the tungsten can be cut and tack welded to the shaft. However, the present invention also lends itself to using alternative materials for the electrode tip and the overwind component such as tungsten for the electrode tip 52 and molybdenum for the overwind component 54. The desired method of attaching the electrode tip and overwind component to the mandrel is achieved by winding a coil around the mandrel.

It will be appreciated that the invention lends itself to different size wires being wound about the mandrel, particularly where dissimilar materials are used for the electrode tip and the overwind component. For example, the diameter of the molybdenum wire forming the overwind component is preferably larger than the diameter of the tungsten wire forming the electrode tip.

The invention has been described with reference to the preferred embodiment. Obviously, modifications and alterations will occur to others upon reading and understanding of this specification. For example, several different types of materials may be used for the mandrel, electrode tip, and overwind component. The invention is intended to include all such modifications and alterations in so far as they come within the scope of the appended claims and the equivalents thereof.

What is claimed is:

1. A ceramic metal halide lamp comprising:

an envelope;

an elongated interior chamber disposed within the envelope having a lamp body located therein;

at least one electrode lead partially housed by the interior chamber;

a single continuous elongated mandrel forming a shaft of the electrode lead;

an electrode tip coil operatively associated with one end of the mandrel; and an overwind component operatively associated with the mandrel at a predetermined position.

2. A lamp according to claim 1, wherein the interior chamber has first and second legs extending therefrom for receiving a first and second lead, respectively.

3. A lamp according to claim 1, wherein the electrode tip coil is formed from tungsten.

4. A lamp according to claim 1, wherein the overwind component is formed from molybdenum.

5. A lamp according to claim 1, wherein the mandrel is formed from a single piece of tungsten wire.

6. A lamp according to claim 1, wherein the electrode lead includes an electrode tip coil disposed at one end of the mandrel and an overwind component received over the other end of the mandrel, the outside diameter of the overwind component being greater than the outside diameter of the electrode tip coil.

7. A ceramic metal halide lamp comprising:

an envelope;

an interior chamber disposed within the envelope; and at least one electrode lead partially housed by the interior chamber having:

a single continuous elongated mandrel;

an electrode tip coil operatively associated with one end of the mandrel; and an overwind component operatively associated with the mandrel at a predetermined position, wherein the outside diameter of the overwind component is greater than the outside diameter of the electrode tip coil.

8. A lamp according to claim 7, wherein the electrode tip coil is formed from tungsten.

9. A lamp according to claim 7, wherein the overwind component is formed from molybdenum.

10. A lamp according to claim 7, wherein the mandrel is formed from a single piece of tungsten wire.

11. A method for improving the strength and stability of electrode leadwires in ceramic metal halide lamps comprising the steps of:

mounting a single continuous elongated mandrel within an inner chamber of a lamp envelope;

attaching an electrode tip coil to an end of the mandrel; and interconnecting an overwind component with the mandrel at a predetermined position.

12. The method according to claim 11, wherein the step of attaching an electrode tip coil to an end of the mandrel includes winding a coil around the end of the mandrel.

13. The method according to claim 11, wherein the step of interconnecting an overwind component with the mandrel comprises winding a wire around the mandrel at a predetermined position.

14. The method of claim 11 wherein the attaching step includes providing a first material to form the coil and the interconnecting step includes providing a second, dissimilar material to form the overwind component.

15. The method of claim 11 wherein the attaching step and the interconnecting step use materials having the same diameter.

* * * * *